US006968255B1

(12) United States Patent
Dimaridis et al.

(10) Patent No.: US 6,968,255 B1
(45) Date of Patent: Nov. 22, 2005

(54) METHOD AND SYSTEM FOR AUTOMATICALLY DERIVING STIPPLING STITCH DESIGNS IN EMBROIDERY PATTERNS

(75) Inventors: Christos Dimaridis, Salonika (GR); Niranjan Mayya, Mississauga (CA); Thanasis Triantafyllidis, Salonika (GR); Yanchun Wang, Mississauga (CA)

(73) Assignee: Pulse Microsystems, Ltd., Mississauga (CA)

( * ) Notice: Subject to any disclaimer, the term of this patent is extended or adjusted under 35 U.S.C. 154(b) by 11 days.

(21) Appl. No.: 10/974,839

(22) Filed: Oct. 27, 2004

Related U.S. Application Data

(60) Provisional application No. 60/621,340, filed on Oct. 22, 2004.

(51) Int. Cl.[7] ..... G06F 19/00; D05C 5/02

(52) U.S. Cl. ..... 700/131; 700/138; 112/475.19

(58) Field of Search ..... 700/131, 132, 700/138, 136, 137; 112/102.5, 475.19

(56) References Cited

U.S. PATENT DOCUMENTS 5,430,658 A * 7/1995 Divinsky et al. ..... 700/138
6,807,456 B1 * 10/2004 Costin et al. ..... 700/132

* cited by examiner

*Primary Examiner*—Peter Nerbun
(74) *Attorney, Agent, or Firm*—Bryan Cave LLP

(57) ABSTRACT

The invention pertains to a method of applying a stippling stitch design to an area defining an asymmetrical polygon in a coordinate planar display format, involving: defining a pathway, which may be based on a fractal design, within a geometrically symmetrical boundary, the pathway comprising a single non-intersecting line; conforming the pathway to an asymmetrical polygon area substantially disposed within the geometrically symmetrical boundary; deriving a plurality of coordinate points representative of the pathway; and passing the points to a data storage medium in a pre-determined embroidery data format.

20 Claims, 5 Drawing Sheets

METHOD AND SYSTEM FOR AUTOMATICALLY DERIVING STIPPLING STITCH DESIGNS IN EMBROIDERY PATTERNS

PRIOR APPLICATIONS

This application is based on a provisional application Ser. No. 60/621,340, which was filed on Oct. 22, 2004 under Express Mail Label No. EU 743 011 526 US and entitled METHOD AND SYSTEM FOR AUTOMATICALLY DERIVING STIPPLING STITCH DESIGNS IN EMBROIDERY PATTERNS.

FIELD OF THE INVENTION

The present invention relates to the creation of embroidery patterns for controlling embroidery machines and more particularly for creating self-generating embroidery design patterns which can be translated into embroidery machine language code for controlling such embroidery machines.

BACKGROUND OF THE INVENTION

Embroidery machines are generally controlled by programs. Often, a separate program is required for each embroidery design. Few systems previously available provide the ability to modify existing embroidery design programs, with such prior art systems, by way of example, varying the parameters associated with a stitch pattern design in order to control stitching machinery, such as is disclosed in U.S. Pat. Nos. 4,326,473; 4,821,662; 4,720,795; 4,352,334; 5,191,536; 4,807,143; 4,849,902. Some of these prior art systems are capable of scaling pattern sizes or making other modifications to existing pattern designs either input by the user or stored in memory. However, these prior art systems do not create a self-generating embroidery design pattern based on fractal geometry where the design conforms to an area defined by an outline boundary, especially one which may be an asymmetrical or irregular polygon shape.

Fractal geometry itself is well known. Examples are described in Computer Graphics: Principles and Practice, 2nd Ed., at page 1020, and in an article entitled "A Unified Approach to Fractal Curves and Plants", by Dietrnar Saupe, at pages 273–286 of The Science of Fractal Images, Springer-Verlage, New York 1988. Our prior U.S. Pat. No. 5,430,638, entitled "Method for Creating Self-Generating Embroidery Design", issued Jul. 4, 1995, the disclosure of which is specifically incorporated by reference herein in its entirety, discloses an efficient method for creating self-generating patterns based on fractal geometry.

However, the use of fractal geometry for self-generating patterns is limited by the ability to calculate and apply the fractal shape to an area within a given outline boundary. Asymmetrical outline boundaries defining irregular polygons, of which embroidered numbers, symbols, paisleys and letters are examples, may likely incorporate curves, corners, or other irregular features that inhibit the application of a fractal algorithm to effectively generate an appropriate fractal shape to represent certain embroidery techniques, such as a stippling stitch pattern, to be applied to that area.

Stippling stitch patterns typically follow a non-intersecting pathway that is usually curving and/or randomly displacing over a given area of an embroidery surface, which may be an embroidered article, fabric or workpiece, for instance, a quilt. Stippling stitch patterns are usually composed of run stitches and provide a raised texture to the surface. In quilting applications stippling is used as a decorative stitch to "quilt" the three layers of a quilt together (the backing, the batting, and the patched or appliquéd top layer. Stippling adds a decorative relief around the appliqué or design in each patch square and has the twin objectives of holding the three layers together as well as being a decorative stitch. The intermittent nature of the stippling and the desire that it be relatively uniformly applied over the area, contrasting raised areas separated by the stippling stitches, distinguish this type of stitching from fill stitching or border stitching, and its seemingly random nature, and curved pattern, make application of automatically generated stippling in machinery embroidered fabrics difficult.

Typically, stippling has been done first by hand manipulation of the work piece by a highly skilled artisan to create the curving visual effect, and then the resulting design is converted to a data format for storage. This may be recorded in stitch data format, or converted to an outline data format that can be further manipulated and edited on a computer display. Yet, the initial manual manipulation requires significant training and experience to arrive at a visually appealing stippling effect. For home embroidery program users this provides a potential drawback in computer based home embroidering systems in that no reliable computer generated pattern could adequately reproduce a desired stippling effect.

The interest in reproducing more complicated and irregular embroidery patterns and designs automatically, while achieving levels of quality formerly restricted to manually created patterns, points out the limitations in using automatically generated fractal shapes to prepare the stippling patterns. This is especially so where, as is usual, the desired stippling area is asymmetrical or irregular.

SUMMARY OF THE INVENTION

Figure 1:
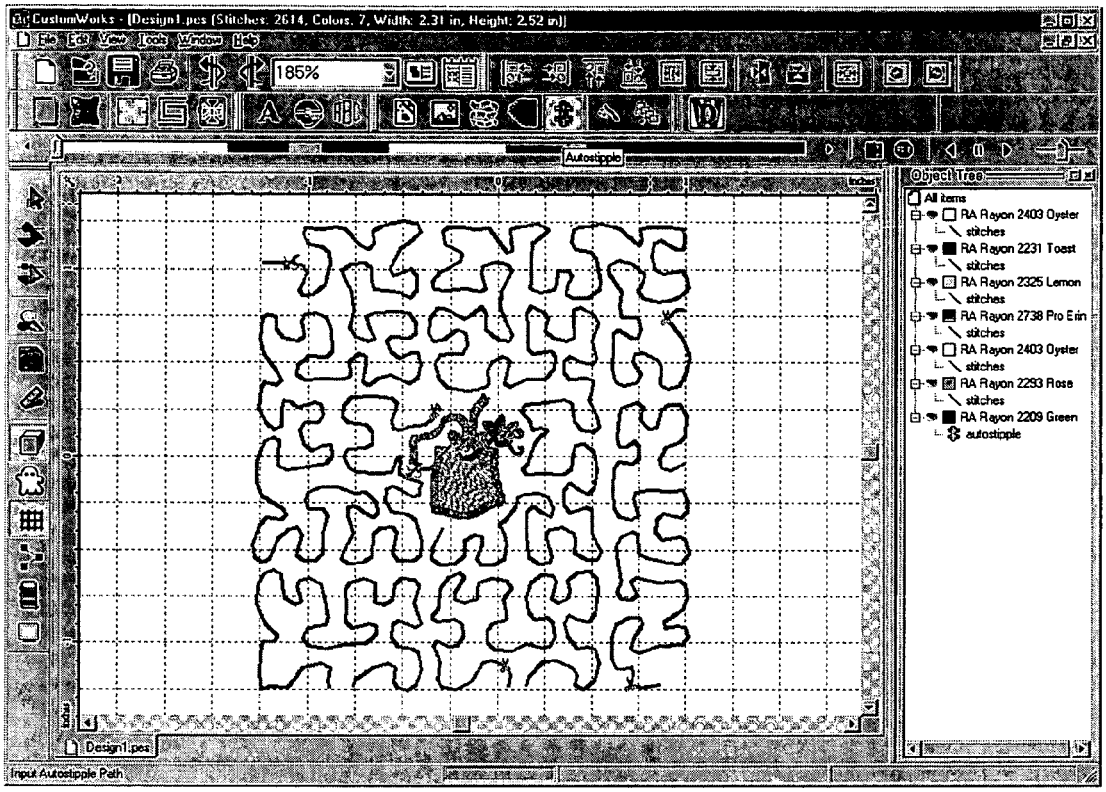
FIG. 1 is a diagram of a graphical user interface on which an embroidery design is represented, which design incorporating a stippling stitch pattern composed of a curving pathway.

The invention pertains to a method of applying a stippling stitch design to an area defining an asymmetrical polygon in a coordinate planar display format, involving: defining a pathway within a geometrically symmetrical boundary, the pathway comprising a single non-intersecting line; conforming the pathway to an asymmetrical polygon area substantially disposed within the geometrically symmetrical boundary; deriving a plurality of points representative of the pathway; and passing the points to a data storage medium in a pre-determined embroidery data format.

The invention further contemplates calculating a fractal based stitch design for an area having a pre-determined shape defining a polygon by selecting a predetermined fractal design; determining a fractal border surrounding an area defining a polygon; defining a pathway within the fractal border based on the selected predetermined fractal design; confining the pathway to the polygon area within the fractal border; and converting the pathway to a data format representing a stippling stitch design within the polygon area.

The terms "user," "users," and the like when referring to a user of the systems and/or methods of this invention should be understood broadly and refer to individuals, organizations, and to automated tools for the entry and receipt of information over communications connections. The automated tool may be a local computer system, network, or node utilized by any user interested in or concerned with the nutritional blend formulations. Thus, a user may be an individual who on behalf of a company for which he or she works enters specifications on his or her home or office computer or input/output device for an embroidery pattern or design.

As used herein, "determine," "determination," "derive," "deriving," "generate," "generating" and the like should be understood broadly and refer to all aspects of determining (e.g., developing, deciding upon, establishing) data or information related to an embroidery design pattern. The present invention provides systems and methods that are accurate, convenient to use, and reliable for facilitating the creation, editing and display of embroidery patterns and designs, and these systems may be connected to other systems inside or outside of the enterprise that provides the systems of this invention. Further features and advantages of the invention will be apparent to those skilled in the art.

DETAILED DESCRIPTION OF THE INVENTION

The present invention relates to a method and system for creating self-generating embroidery design patterns, preferably stippling patterns, within a pre-determined surface area having an outline boundary defining an asymmetrical polygon shape or region of the surface.

"Surface" or "surface area", as used herein, encompasses those surfaces digitally or otherwise represented on a coordinate or caretsian based graphical user interface, such as a computer monitor, or other electronic screen display, for instance, one used to generate stitch segment data that would be used by an embroidery machine to apply a design to an embroidery workpiece or surface. Similarly, "outline boundary" or "boundary" encompasses a line, line segment or segments, stitch region or spatial limitation used to define at least a portion of the surface or surface area, which also may be digitally or otherwise represented on a coordinate or cartesian based graphical user interface, such as a computer monitor or other electronic screen display, as described. "Polygon shape" encompasses the shape of the surface area defined by the outline boundary, including shapes substantially defined by those outline boundaries which are in some respects open and not completely enclosed by the outline or boundary. "Points" or "coordinate points" as used herein references locations on the planar surface of a display, or other representation of an embroidery surface, which points may or may not correlate to "outline points" used to represent stitch segments in a data storage and display medium. It is to be understood that while a line, line segment or other shape, boundary, outline or other construct may be discussed herein as having, or being defined or represented by, coordinate points, or by associated or corresponding coordinate points, the spatial or numerical relationship between the points and the particular construct(s), may encompass, for example, points on, adjacent, near, or proximate to the particular line or other limiting outline or boundary defining the particular shape, area, region or portion of the surface.

Preferably, the method and system utilizes a conventional embroidery computer aided design system to automatically apply a pathway representing a stippling pattern on the desired surface area, for instance, on a graphical user interface of a computer system. An example of such interface, in this case a computer monitor screen display, is illustrated by FIG. 1. Where representing a stippling pattern, the pathway is represented on the surface as a continuous, or substantially continuous, line (which may vary as to thickness and other dimensions) usually curving, but may also be jagged or zig-zagged, or a combination of these. Representation of the pathway may also be as a series of continuous, or substantially continuous, line portions, segments, points, or other form or format to represent and/or create an embroidery stippling pattern.

In its formulation and/or application to a surface, the pathway may be displaced either randomly or uniformly along its length and/or segments, and which may be based on iterative repetition of a fractal shape. Preferably the pathway will comprise a curving and/or directionally displacing non-intersecting line that will correspond to a stippling pattern extending substantially uniformly and/or evenly over the surface area, as illustrated in the example at FIG. 1. The invention and the various functions, steps, methods and operations may be coded in a machine readable medium, an individual application, or encompassed within a computer program containing instructions for a user to create, view, manipulate and/or modify digitally represented embroidery designs, which may be offered also within a program suite, and may be accessible and/or downloadable from or over a network, and/or residing in or stored by a database or other components, system or functionality.

Preferably, the invention comprises, is part of, or is used with a computer program which assists a user in creating embroidery designs, and will generate the necessary stitch commands for recreating the embroidery design on an embroidery surface using an embroidery stitching machine. The program may operate on a PC, or other compatible computer platform which performs the required data processing as hereinafter described. However, the invention may be operable on a variety of computer systems, and be implemented in either hardware or software. While a design is being worked on, the system preferably maintains it in random access memory (RAM) and displays the design on a monitor, television screen or other display means. Once it is desired to store the design, a hard disk, digital disk, or floppy disk, or other suitable data storage medium, may be used for long-term storage of designs, and any program software, modules, functionalities or coding.

As may be seen in the example in FIG. 1, the program may be menu-based, and includes a plurality of interrelated data entry and design screens for entering embroidery representations in either outline or stitch format. Each screen preferably includes icons, data entry boxes, or other screen displays for allowing a user to enter design information, and for the system to provide informational messages to the user. Screen displays are provided in which program functions are presented in lists, icons and short cuts, from which a user then picks the item or function that is desired to be performed from the list. Additionally, the system preferably includes "hotkey" functions which allow the user to activate often used functions with a reduced number of keystrokes.

Choosing certain menu items may result in another menu being presented, for example when main menu items are chosen. It is understood that the various features and functions of the present invention may be mapped into the keyboard keys, mouse buttons or digitizer puck in a variety of combinations, as desired for the particular application. Furthermore, it is readily understood that the menu organization as herein described is but one possible organization of the many features described.

In the program embodiment of the invention, each identification herein of functions performed by the program for doing something or of steps performed in the course of carrying out a method, whether or not expressly recited as a program function or in connection with an algorithm, module, routine, subroutine or other code or component for performing those functions refers to and encompasses all possible embodiments, structures, and steps for performing the function(s), including various possible architecture and programming formats. These functions may be provided and performed through the use of various components, computers, and other elements and techniques, including hardware, firmware, software, databases, routines, programs, algorithms, engines, plug-ins, or other structures within a computer or system that may be used to provide and/or perform the particular function(s) identified. Moreover, combining or separating one or more steps, methods or functions in or between various components, computers, systems, programs, or program subunits are contemplated by the invention and are within its scope.

In addition, operation and performance of the steps, methods and functions identified herein may also be interrelated and/or accessible to a user through various interconnections or otherwise networked in ways known to the art. Each of the functions and components may be close to or remote from one another, either geographically or within a host structure. As noted above, the consolidation of the various functions of the system into the components identified herein is to illustrate the functions and their cooperation and interaction and does not and should not be understood to limit the location of these functions to being within particular components or to limit the location of these components to being within particular structures. A system implementing the program embodiment may encompass any of a number of operating software, microprocessors, memory devices or systems tools to provide a given architecture for implementing the method and functions, for instance to provide a centralized ability for a user to manipulate the system and its components through a graphical user interface which may be a computer screen or other suitable computer display, as well as the circuitry, processors and programs required to render, manipulate and display images based on data stored electronically in a data storage medium either remote to or within a computer or network system.

The system implementing the program embodiment may include a database for selecting and retrieving a pre-determined pathway and/or fractal shapes from a number of stored processes pertaining to the creation of certain pathways or shapes. Additionally or alternatively the database may receive or include means for creating fractal shapes or pathways by a user, and for storing such shapes or pathways for use in stippling or other embroidery applications. A shape or pathway may be searched for or accessed by retrieval functions within the system, program and/or network, and displayed by the user control module on the graphical user interface.

The data representing completed stippling design pattern may preferably be output and stored on different types of media in either stitch data or outline data form to be used in conjunction with conventional embroidery machines. The data is preferably derived based on determined coordinate outline points, for instance, as described in U.S. Pat. No. 5,270,939, which disclosure is specifically incorporated by reference herein. Using these points, other components of the system, not pictured, generate the stitches for the design at the size and density entered by the user. Typically, given their size and nature, the coordinate points for stippling stitches are assigned run stitches, the run stitches together then defining segments of stitches preferably passed to the system in outline data format.

The pathway representing the stippling design pattern may be generated by any effective method, for instance, a computer program that will allow for a regularly curving and/or meandering line to be imposed over an area represented on a coordinate plane, for instance, a surface depicted on a graphical user display. In the preferred embodiment, the pathway is generated automatically by the system based on the mathematical principle of fractal geometry. Fractal geometry involves sets of points that are generated by relatively simple calculations repeated over and over, feeding the results of each step back into the next. There are many categories of fractals each of which can be manipulated in a virtually infinite number of ways. An example of fractals as applied to embroidery designs are provided in U.S. Pat. No. 5,430,658, which disclosure is incorporated herein by reference. For purposes of representing stippling patterns in an irregular or asymmetrical area, the fractal is first applied within a geometrically symmetrical area bordering the desired asymmetrical area, preferably a rectangle or square, to provide a baseline for the fractal iterations.

Generally, and in accordance with the presently preferred method, the fractal generation creates a pathway as desired, e.g., in the scale, density, and coverage sought, over the asymmetrical area and within the geometrically symmetrical border surrounding the asymmetrical area. The pathway is then "clipped" or otherwise so limited to the outline boundary defining the area, usually shaped as an irregular polygon, and the coordinate points associated with the pathway based on the fractal shape are determined.

Once the coordinates associated with the pathway have been determined, these points are converted to embroidery outline and stitch data with a user defined stitch length, such as for example 2 mm, preferably being utilized as the maximum stitch length and any line segment longer than that length preferably being broken up into smaller stitches. As stippling patterns are comprised of run stitches, the points will define a plurality of run stitch segments that form the stippling. Preferably, actual conventional embroidery machine language codes are generated for each stitch for use in conventionally controlling the embroidery machine. The design is preferably stored in outline data form for ease of editing.

Figure 2:
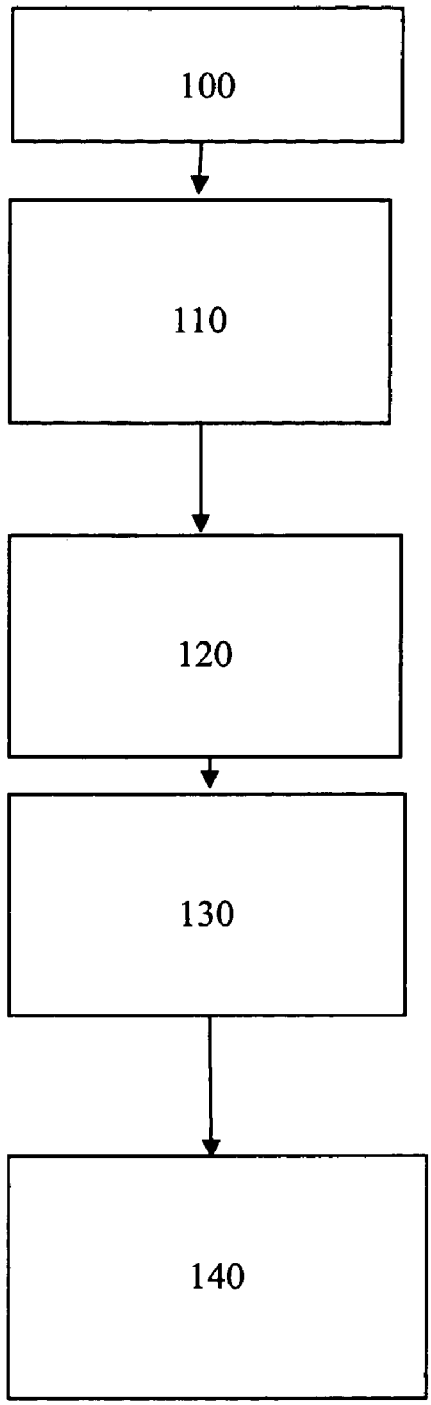
FIG. 2 is diagrammatic illustration of a flow diagram of a method of the present invention.
Figure 4:
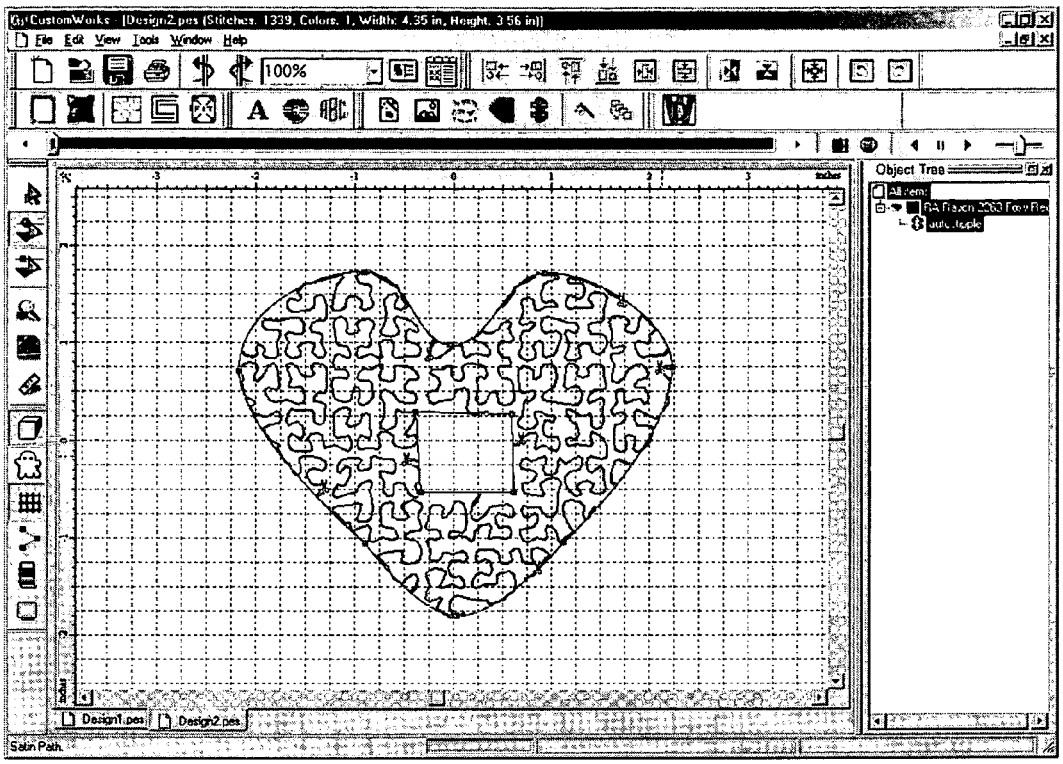
FIG. 4 is a diagram of a graphical user interface on which an embroidery design is represented, which design incorporating a stippling stitch pattern within a heart shaped boundary outline.

The method of the invention will be further described with respect to the drawings. FIG. 2 is a flow chart of the preferred method. Using a graphical user interface or other display, preferably representing a two dimensional coordinate planar surface representation of an embroidery work piece surface, having a Cartesian coordinate axis, an outline boundary is provided defining an irregular or asymmetrical area of the surface to which the user desires to apply a stippling embroidery pattern. Such an outline boundary may be an oval or circular patch area, or part of a larger embroidered design, or it may be lettering or numbering. The shape is preferably defined using coordinate points which may be derived from outline data for the shape supplied from a stored data source, allowing the shape to be represented, stored and edited in a computer system and displayed on a graphical user interface. An example of such outline boundary may be viewed in the heart shape outline in FIG. 4.

At functional block 100, a symmetrical geographic border is plotted around the shape, preferably by the creation of a bounding rectangle or square bounding the shape of the polygon. Methods for automatically creating and displaying a bounding square or rectangle around a given polygon area are known in the art.

The area to which the fractal shape will be applied is an outline boundary representing a bordered stitch area defining a shape of an irregular or asymmetrical polygon. The representation of the area is conducted using methods and apparatus for CAD known to the art, for instance, plotted as coordinate points on a Cartesian or similar type coordinate plane. Given a particular polygon, and irregularities in its outline shape, applying the fractal shape to the area so defined is performed by framing the polygon with an encompassing geometrically symmetrical, preferably rectangular, border which frames the polygon, for instance, by placing the lines along the x and y axis at a pre-determined displacement distance from the highest and lowest absolute values of the coordinate locations of respective edges of the polygon.

At functional block 110, a pathway is applied to the area defined by the bounding square or rectangle. Preferably, the pathway comprises generating a line based on a pre-determined fractal shape. The user may first specify or select a desired fractal shape, e.g. a shape having a coded axiom and rules associated with its fractal generation, such as by selecting one from memory or by defining a new one. The axiom and rules associated with the particular fractal shape are then performed to achieve a pre-determined number of iterative sequences for the fractal shape such that it creates a pathway substantially uniform over the area of the bounding square or rectangle.

Within the framework, this fractal shape is constructed, for instance, by repetition of a Hilbert based geometric pattern composed of basic straight segments oriented along one or other of two orthogonal directions. From such a pattern, a pathway representing a stippling pattern can be constructed disposed substantially uniformly over the bounded area and passing through any point only once. This sequence can be repeated n number of iterations until a pathway of sufficient density within the bounding square or rectangle is obtained.

At functional block 120, the pathway is conformed to the outline of the bounding square. This may be performed by "clipping" or limited to the outline of the polygon intrinsic to the bounding square. In the preferred embodiment, the clipping is accomplished through application of codes or algorithms. An example of a suitable algorithm for clipping is described in the following Table 1.

TABLE 1

Clipping Algorithm Description:

Input:

1) The shapes: list for various pathway bezier curves. It will be called "shape curves" later.
2) The curve: list of DPoint representing a polyline (or a PBezierCurve). It will be called "pattern curve" to distinguish from the "shape curves".

TABLE 1-continued

Clipping Algorithm Description:

Output:

1) Clipped curves: list of DPoint representing a list of polylines (or list of PBezierCurves).

Algorithm:

1: Find all intersection points of the shape curves and the pattern curve. Actually, we only want to get the (k, t) pairs at the intersection points for the pattern curve and the (k, t) pairs of the intersection points for the shape curves (the second (k, t) pairs are optional.

Note: 1) For some straight line segments even if they are not collinear, a suitable function must apply.
2) For two straight line segments that are parallel (including the cases of collinear, or just parallel but not collinear, a suitable function must apply.

Solution to problem 1) Use the following method for finding the intersections of two line segments that are not collinear. If any of the two line segments is a point, then we do not need to find the intersection because other pattern curve adjacent to this point will give us right intersection (k, t) pairs. So, we can assume that both the line segments are not single point.

Let the first line segment be

L1(t) = A + t * V0 where A is the start point of L1(t), and V0 is the direction vector of L1(t)

L2((m) = B + m * V1 where B is the start point of L2(m), and V1 is the direction vector of L2(m)

And we denote N0 to be the vector perpendicular to V0, N1 is the vector perpendicular to V1, then we can get the intersection parameter as follows:

m = N0 * (A − B)/(N0 * V1) here N0 * V1 != by the above assumption t = N1 * (B − A)/(N1 * V0) here N1 * V0 != by the above assumption.

if 0 <= t <= 1 and 0 <= m <= 1, then we found an intersection point, combing the index of the first line segment and the index of the second line segment, we can get the (k, t) pairs for both lines.

Solution to problem 2) Use the following way for two parallel line segments.

Suppose that A and B are the starting and ending points of the first line segment, and C and D are the starting and ending points of the second line segment, we can assume that any of the two line segments are not a single point as it is not necessary to find intersection for them for same reason as that in above solution 1).

We denote

V0 = B − A as the direction vector of the first line segment
V1 = D − C a the direction vector of the second line segment
AC = C − A is the vector from point A to point C
AD = D − A is the vector from point A to point D
CA = A − C is the vector from point C to point A
CB = B − C is the vector from point C to point B If the cross product of V0 and AD, or V0 and AD is not zero, then the teo line segments don't intersect each other, actually they are not collinear. The same is true, if the cross product of V1 and CA, or V1 and CB is not zero.

Otherwise, we can find intersection parameters of the two line segments as follows:

n0 = V0 * AC/(V0 * V0)
n1 = V0 * AD/(V0 * V0)
m0 = V1 * CA/(V1 * V1)
m1 = V1 * CB/(V1 * V1)

If (n0 < 0 or n0 > 1) or (n1 < 0 or n1 > 1) and (m0 < 0 or m0 > 1) or (m1 < 0 or m1 > 1), then the two line segments do not intersect; else we will find two intersections, assume that n0 and n1 are the parameter values for the intersections on the first line segment, and m0 and m1 are the parameter values for the intersections on the second line segment, then we have if n0 < 0, then n0 − max(0, n0) else n0 = min(1, n0)
if (n1 < 0, then n1 = max(0, n1), else n1 = min(1, n1)
if (m0 < 0, then m0 = max(0, m0), else m0 = min(1, m0)
if (m1 < 0, then m1 = max(0, m1), else m1 = min(1, m1)

combing the index information of the two line segments and above parameters n0, n1, m0 and m1, we can get the (k, t) pairs for the first and second line segments.

2. Sort the (k, t) pairs of the pattern curve in ascending order, changing the order of the (k, t) pairs for the shape curves simultaneously while sorting if we want to use shape curves' (k, t) pairs.

TABLE 1-continued

| Clipping Algorithm Description: |
|---|
| 3. Eliminate some duplicate (k, t) pairs of the pattern curve and the corresponding (k, t) pairs of the shape curves. For example, if there are two (k, t) pairs to be the same, then we only need one of them. Sometimes, duplicate (k, t) pairs may happen, such as at the place where two shape curves are adjacent.<br>4. Split the pattern curve based on the intersection (k, t) pairs for the pattern curve, and get a list of pattern curve segments.<br>5. Clip every pattern curve segment against the shapes. Check whether a segment is inside the shapes or not. If the pattern curve segment is inside the shapes, add it into the clipped curve list, and add connection information into the connection list.<br>6. Output the result. |

At functional block 130, coordinate points from the coordinate planar surface display associated with the pathway generated are derived, preferably in outline data format, although these may also be derived in stitch data format, for instance, where the output will be directly to an embroidery machine, and not to a database, or other electronic storage medium. The points may be outline points, as described previously in U.S. Pat. No. 5,430,658, the disclosure of which is incorporated herein by reference, or other types of points sufficient to draw, design, and represent an embroidery pattern and to output that pattern to guide the operation of an embroidery machine on fabric or other applicable work piece or surface. Outline points may be derived from Cartesian coordinate points that are on the pathway, or which are substantially adjacent or spatially associated thereto. The resulting outline data that is generated based on the outline points is then used to create stitches for, in this instance, the stippling design.

At functional block 140, the outline points are passed to a data storage medium in a embroidery data format, which as discussed may be either in stitch or outline data formats. The data storage medium may be an electronic medium storing either outline or stitch data, or may also be tape or other non-electronic storage medium for stitch data.

Figure 3:
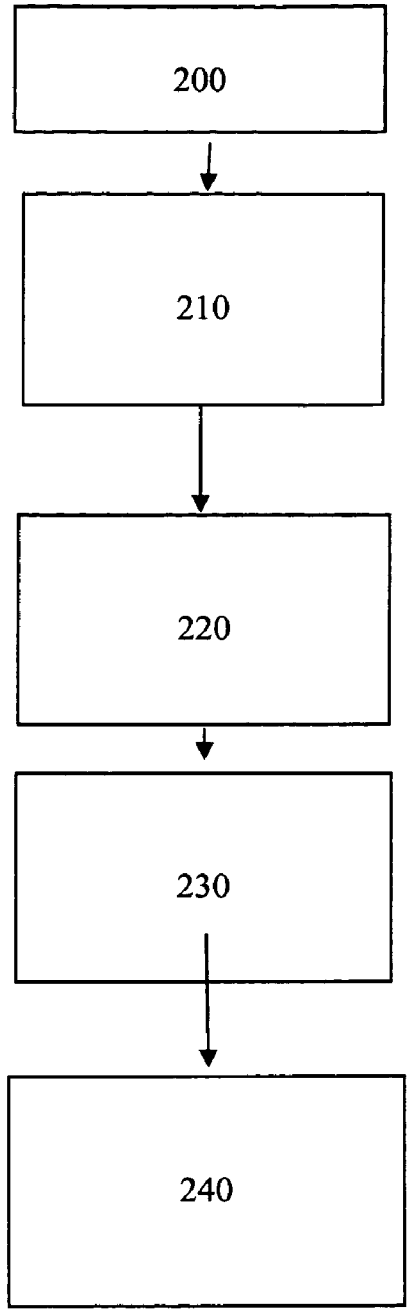
FIG. 3 is a diagrammatic illustration of a flow diagram of the randomizing curve portion of a method of the present invention.

FIG. 3 illustrates a flow chart of a further method according to the preferred embodiment wherein pathway contours or shapes, preferably derived through repetitive fractal iterations, are converted or conformed to smooth curves, which may also have randomized displacements, and adjusted to enhance the visual appeal of the design. As the fractal design may feature sharp edges or angles that will affect the overall look of the resulting stippling, steps are added to manipulate the points derived from the pathway.

At functional block 200, the predetermined fractal shape is generated for the pathway as previously discussed. The pathway defining a non-intersecting line curving substantially uniformly over the area of the polygon. The line at this stage may or may not have been used to derive a plurality of outline or stitch points for storage or instructing an embroidery patter, nonetheless, as a line in a coordinate plane, the pathway has associated points determining its placement and disposition. From these coordinate points, which again may or may not be or coincide with stitch or outline points as embroidery data, manipulations to the pathway are done to provide a more smooth curve.

At functional block 210, the points of the pathway are each displaced a distance, the displacement distance for each point is randomly determined within a range of possible distances according to an applied pre-determined factor.

At functional block 220, the points are each converted to "smooth" line points, wherein the line at each point is tapered gradually to form a smooth curve, which may be accomplished by generating a bezier curve, rather than a sharp angular vector break, between points. For instance, it is known in the art to generate a smooth curve of a bezier curve by interpolating the curve among or in a vicinity of coordinate points. Algorithms for generating bezier curves geometrically using extra-linear control points determined for each curve can be employed and are preferred.

At functional block 230, the conversion of each point to "smooth" creates a pattern formed of multiple bezier curves, generated based on the random curvatures of the pathway. In the preferred embodiment, the "smoothing" and/or randomizing is accomplished through application of codes or algorithms. An example of a suitable algorithm for "smoothing" and randomizing is described in the following Table 2.

TABLE 2

| Description of Smoothing and Randomizing Algorithm: |
|---|
| Using a list of points of the original pattern shape make the shapes and curves randomly smooth by replacing this list of points with a new list of bezier triple points.<br>The random extent is determined by a random factor, and the smooth method is given internally. So, the algorithm can be described as follows:<br>Input:<br>1) The raw pattern shape: a list of points, theOrgShapePoints;<br>2) The random factor: theRandomFactor;<br>Output:<br>1) The randomly smooth pattern shape: a list of bezier triple points, TheBPoints.<br>Algorithm:<br>1. Loop through the list of original pattern shape points, theOrgShapePoint, to get a list of randomized points inside shape and connection information, theRawShapePoints.<br>The random processing is simply made by the following formula:<br>dx = m_len * (rand( )/(RAND_MAX) − 0.5) * theRandomFactor;<br>dy = m_len * (rand( )/(RAND_MAX) − 0.5) * theRandomFactor;<br>thePoint.x += dx;<br>thePoint.y += dy;<br>where thePoint is the point to be random processed.<br>2. From the raw shape points list, we take every three successive points, theRawShapePoints[i − 1], theRawShapePoints[i], and theRawShapePoints[i + 1], and get two vectors:<br>v1 = theRawShapePoints[i − 1] − theRawShapePoints[i], and<br>v2 = theRawShapePoints[i + 1] − theRawShapePoints[i];<br>where i > 0 and i < the Length − 1 of theRawShapePoints;<br>3. Calculate the angle of the two vectors: theAngle<br>4. Get pre-direction point and the post-direction point of theRawShapePoint[i]: preDirPoint = (1/3*theRawShapePoint [i − 1] + 2/3*theRawShapePoint[i])/3; postDirPoint = (1/3 *theRawShapePoint[i + 1] + 2/3*theRawShapePoint[i])/3;<br>5. Rotate the direction points base on theRawShapePoints[i] by theAngle as follows:<br>theAngle = PI/2.0 − theAngle/2.0;<br>if (fabs(theAngle) >= PI/2.0)<br>theAngle += −PI;<br>Rotate preDirPoint by theAngle;<br>Rotate postDirPoint by −theAngle;<br>6. Put the triple: (preDirPoint, AnchorPoint, postDirPoint) into the list of triple points, theBPoints. Here the anchorPoint = theRawShapePoint[i].<br>7. Repeat step 2 to step 6 until all the raw shape points are processed.<br>8. Output the result of bezier triple points: theBPoints. |

At functional block 240, the "smoothed" pathway, which may include randomized curve displacement, is then clipped so that the curve is represented only in the polygon area, which area is intrinsic to the bounding rectangle or square, as described with respect to FIG. 2 and, for example, according to an algorithm such as in described in Table 1.

Figure 5:
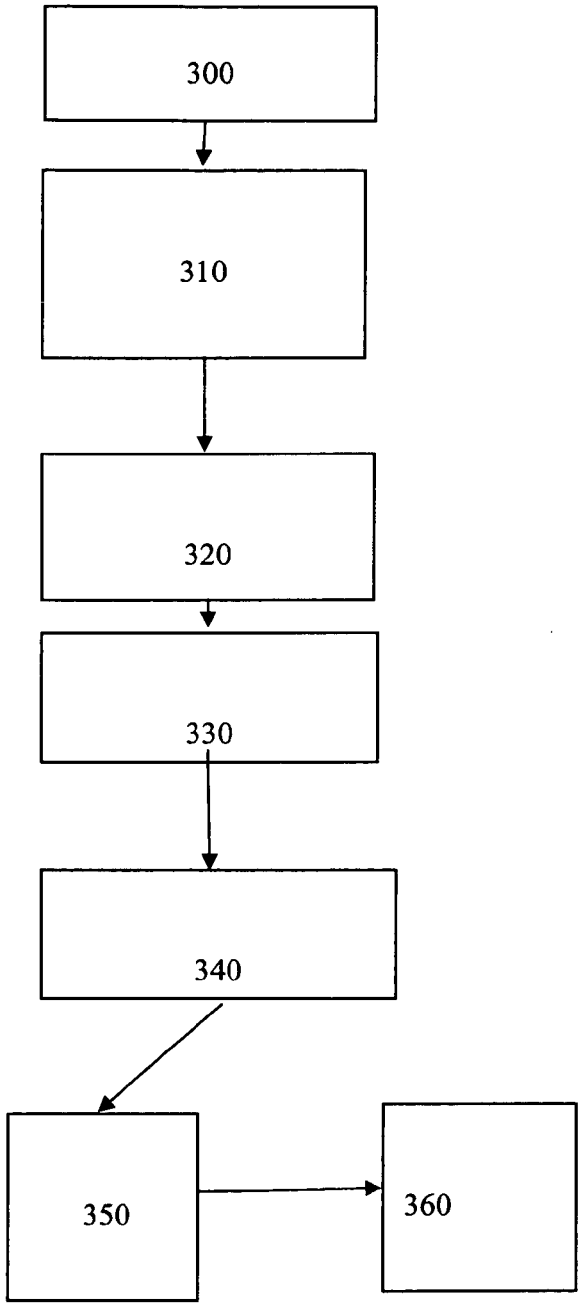
FIG. 5 is a diagrammatic illustration of a flow diagram of one embodiment of the present invention.

Methods which may otherwise combine the functions, algorithms, process or steps illustrated in FIGS. 2 and 3 to effect both the splitting of a pathway and the smoothing/ randomizing of its fractal design are also within the scope and contemplation of the invention. For instance, such a combination may be a method of creating a fractal based stippling stitch design for application to an area having a pre-determined outline boundary substantially defining an irregular polygon, illustrated in FIG. 5. Such exemplary method would involve selecting a predetermined fractal shape and generating a symmetrical fractal border substantially encompassing the polygon 300. Then defining a fractal design within the fractal border based on iterative repetition of the pre-determined fractal shape 310, the fractal design comprising a plurality of line segments and selecting a plurality of coordinate points representing the fractal design and 320 displacing the coordinate points a random coordinate displacement distance. Smoothing of the fractal design may involve determining object points associated with the coordinate points and calculating bezier curves with respect to the object points and the coordinate points 330. Clipping the pathway so defined by the fractal design may involve defining at least one point of intersection between at least one line segment of the fractal design and the outline boundary and splitting each line segment at the point of intersection so as to define a first split line segment and a second split line segment 340. Once determined whether the coordinate points defining each of the first split line segment and the second split line segment are within the outline boundary, and where said coordinate points are determined to be within the outline boundary, one or both of the corresponding line segments may be passed as data to a data storage medium in a pre-determined embroidery data format 350. These are coordinated with one or more other line segments comprising the pathway and stitch segment(s) created conforming to the one or both line segments passed 360.

Although the present invention has been described in detail with respect to certain embodiments and examples, variations and modifications exist which are within the scope of the present invention as defined in the following claims.

We claim:

1. A method of creating a self-generating stippling stitch design applicable to an area of an embroidery work piece substantially within a border defining an asymmetrical polygon depicted on a coordinate planar display surface, the method comprising the steps of:

a) applying a pre-determined pathway within a substantially geometrically symmetrical boundary, the pathway comprising a single non-intersecting line;

b) conforming the pathway to an asymmetrical polygon area substantially disposed within the boundary;

c) selecting a plurality of coordinate points representative of the pathway; and d) passing the coordinate points to a data storage medium in a pre-determined embroidery data format; and e) creating a plurality of stitch segments based on the coordinate points.

2. The method of claim 1, further comprising the step of representing at least one of the coordinate points and the plurality of stitch segments on the display.

3. The method of claim 1, wherein the pathway is derived from a pre-determined fractal shape repeated a pre-determined number of iterations.

4. The method of claim 1, wherein the coordinate points are located on or substantially near the pathway.

5. The method of claim 1 wherein the data format is stitch data.

6. The method of claim 1 wherein the data format is outline data.

7. The method of claim 6, further comprising converting the outline data to stitch data.

8. The method of claim 2, further comprising manipulating at least one of the coordinate points and the stitch segments on the display.

9. The method of claim 1, wherein the outline boundary is represented on the display by reading coordinate points associated with the outline boundary, the coordinate points in a pre-determined embroidery data format.

10. The method of claim 8, further comprising passing at least one of the coordinate points and the plurality of stitch segments to a data storage medium in a pre-determined embroidery data format.

11. The method of claim 10, further comprising passing at least one of the coordinate points and the stitch segments for the edited polygon border to a data storage medium in a pre-determined embroidery data format.

12. A method of calculating a fractal based stippling stitch design for application to an area having a pre-determined outline boundary substantially defining an irregular polygon, the method comprising the steps of:

a) selecting a predetermined fractal shape;

b) generating a symmetrical fractal border substantially encompassing the polygon;

c) defining a fractal design within the fractal border based on iterative repetition of the pre-determined fractal shape;

d) conforming the fractal design to the polygon area within the fractal border; and e) converting the fractal design to an embroidery data format.

13. The method of claim 12, wherein the step of defining the fractal design further comprises selecting a plurality of coordinate points associated with the fractal design and displacing the coordinate points a random coordinate displacement distance.

14. The method of claim 13, wherein the step of defining the fractal design further comprises determining object points associated with the coordinate points and calculating bezier curves based on the object points and the coordinate points.

15. The method of claim 14, wherein the step of converting the fractal design comprises determining run stitch segments based on the bezier curves and the coordinate points.

16. A method of applying a pre-determined stippling stitch design applicable to an area of an embroidery work piece depicted on a coordinate planar display surface, the method comprising the steps of:

a) providing a pre-determined area having an outline boundary for application of the stippling stitch design;

b) substantially encompassing the outline boundary within a substantially geometrically symmetric boundary;

c) applying a pre-determined pathway representing a stippling stitch design substantially within the symmetric boundary, the pathway comprising an interconnected succession of line segments, each segment defined by coordinate points;

d) defining at least one point of intersection between at least one line segment of the pre-determined pathway and the outline boundary;

e) splitting each line segment at the point of intersection so as to define a first split line segment and a second split line segment;

f) determining whether the coordinate points defining each of the first split line segment and the second split line segment are within the outline boundary;

g) where said coordinate points are determined to be within the outline boundary, passing one or both of the corresponding line segments to a data storage medium in a pre-determined embroidery data format;

h) coordinating one or both of the corresponding line segments passed with one or more other line segments comprising the pathway; and i) creating at least one stitch segment conforming to the one or both line segments passed.

17. The method of claim 16 wherein the data format is stitch data.

18. The method of claim 16 wherein the data format is outline data.

19. The method of claim 16, wherein the outline boundary is represented on the display by reading coordinate points associated with the border, the coordinate points in a pre-determined embroidery data format.

20. A method of creating a fractal based stippling stitch design for application to an area having a pre-determined outline boundary substantially defining an irregular polygon, the method comprising the steps of:

a) selecting a predetermined fractal shape;

b) generating a symmetrical fractal border substantially encompassing the polygon;

c) defining a fractal design within the fractal border based on iterative repetition of the pre-determined fractal shape, the fractal design comprising a plurality of line segments;

d) selecting a plurality of coordinate points on or substantially adjacent to the fractal design and displacing coordinate points a random coordinate displacement distance;

e) determining object points associated with the coordinate points and calculating bezier curves with respect to the object points and the coordinate points;

f) defining at least one point of intersection between at least one line segment of the fractal design and the outline boundary;

g) splitting each line segment at the point of intersection so as to define a first split line segment and a second split line segment;

h) determining whether the coordinate points defining each of the first split line segment and the second split line segment are within the outline boundary;

i) where said coordinate points are determined to be within the outline boundary, passing one or both of the corresponding line segments to a data storage medium in a pre-determined embroidery data format;

j) coordinating one or both of the corresponding line segments passed with one or more other line segments comprising the pathway; and k) creating at least one stitch segment conforming to the one or both line segments passed.

* * * * *